US011905059B2

(12) United States Patent
Price et al.

(10) Patent No.: US 11,905,059 B2
(45) Date of Patent: Feb. 20, 2024

(54) PACKAGING MACHINE FOR BEDDING PRODUCTS

(71) Applicant: Atlanta Attachment Company, Lawrenceville, GA (US)

(72) Inventors: Larry Price, Buford, GA (US); Charles A. Camp, Loganville, GA (US); Greg Craig, Cumming, GA (US)

(73) Assignee: ATLANTA ATTACHMENT COMPANY, Lawrenceville, GA (US)

( * ) Notice: Subject to any disclaimer, the term of this patent is extended or adjusted under 35 U.S.C. 154(b) by 37 days.

(21) Appl. No.: 17/490,165

(22) Filed: Sep. 30, 2021

(65) Prior Publication Data

US 2022/0017250 A1 Jan. 20, 2022

Related U.S. Application Data

(63) Continuation of application No. 16/136,915, filed on Sep. 20, 2018, now Pat. No. 11,136,154.

(60) Provisional application No. 62/561,730, filed on Sep. 22, 2017.

(51) Int. Cl.

| | |
|---|---|
| ***B65B 11/50*** | (2006.01) |
| ***B65B 51/14*** | (2006.01) |
| ***B65B 25/00*** | (2006.01) |
| ***B65B 9/02*** | (2006.01) |
| *B65B 63/02* | (2006.01) |
| *B65B 41/16* | (2006.01) |
| *B65B 35/24* | (2006.01) |

(52) U.S. Cl.

CPC ..... *B65B 51/14* (2013.01); *B65B 9/026* (2013.01); *B65B 11/50* (2013.01); *B65B 25/00* (2013.01); *B65B 35/24* (2013.01); *B65B 41/16* (2013.01); *B65B 63/02* (2013.01)

(58) Field of Classification Search

USPC ..... 53/436

See application file for complete search history.

(56) References Cited

U.S. PATENT DOCUMENTS 3,564,810 A 2/1971 Faletti et al.
3,965,653 A 6/1976 Lerner
(Continued)

FOREIGN PATENT DOCUMENTS

WO WO-2018236687 A1 * 12/2018 ..... B31D 5/0073

*Primary Examiner* — Chinyere J Rushing-Tucker
(74) *Attorney, Agent, or Firm* — BURR & FORMAN LLP

(57) ABSTRACT

A packaging machine for packaging a product. The machine has a frame for supporting the product and a source of packaging material for supplying packaging material into a position to be engaged by and at least partially surround the product. At least one upper sealing assembly is adapted to move between an actuated position and a non-actuated position. The upper sealing assembly comprises at least one sealing element for forming a seal along adjacent edges of the packaging material. At least one lower sealing assembly is adapted for cooperating engagement with the upper sealing assembly in its actuated position. The at least one upper and lower sealing assemblies are positioned for clamping engagement of the packaging material therebetween for forming the seal when the upper sealing assembly is moved to its actuated position in engagement with the lower sealing assembly.

20 Claims, 11 Drawing Sheets

(56) References Cited

U.S. PATENT DOCUMENTS 4,711,067 A * 12/1987 Magni ..... B65B 63/02 53/430
4,779,400 A 10/1988 Hoskinson et al.
4,858,416 A 8/1989 Monaghan
4,869,051 A 9/1989 Shifley et al.
5,042,227 A 8/1991 Merry
5,172,629 A 12/1992 Merry
5,271,498 A 12/1993 Gillespie
5,408,808 A 4/1995 Masuda
5,622,030 A 4/1997 Steed et al.
5,664,408 A 9/1997 Chesterfield
RE36,142 E 3/1999 Steed et al.
5,934,041 A 8/1999 Rudolf et al.
6,021,725 A 2/2000 Resta
6,032,345 A 3/2000 Resta
6,079,341 A 6/2000 Resta
6,098,378 A 8/2000 Wyatt
6,129,030 A 10/2000 Resta
6,178,723 B1 1/2001 Mossbeck
6,220,457 B1 4/2001 Resta
6,223,666 B1 5/2001 Resta
6,250,238 B1 6/2001 Resta
6,273,257 B1 8/2001 Mossbeck
6,298,510 B1 10/2001 Mossbeck
6,357,209 B1 3/2002 Mossbeck et al.
6,408,773 B2 6/2002 Resta
6,467,239 B2 10/2002 Mossbeck et al.
6,502,375 B2 1/2003 Resta
6,634,307 B2 10/2003 Resta
6,637,177 B1 * 10/2003 Trillich ..... B65B 31/00 53/436
6,640,520 B2 11/2003 Gecic
6,702,224 B2 3/2004 Resta
6,735,923 B1 5/2004 Resta
6,739,107 B1 5/2004 Lewis et al.
6,779,471 B2 8/2004 Resta
6,789,371 B1 9/2004 Buysman et al.
6,804,940 B2 10/2004 Resta
6,810,643 B1 11/2004 Gecic et al.
6,892,448 B2 5/2005 Gecic
6,901,722 B2 6/2005 Dextraze et al.
6,983,706 B2 1/2006 Marcangelo
7,000,269 B2 2/2006 Borda
7,017,854 B2 3/2006 Gecic et al.
7,021,227 B2 4/2006 Marcangelo
7,059,101 B2 6/2006 Dextraze et al.
7,147,106 B2 12/2006 Kowalski et al.
7,328,556 B2 * 2/2008 Taylor, Sr. ..... B29C 66/849 53/434
7,383,676 B1 * 6/2008 Schmidt ..... B65B 9/026 53/553
8,739,716 B2 6/2014 Price et al.
8,739,974 B2 6/2014 TeVault et al.
8,950,164 B2 2/2015 Resta et al.
9,839,301 B2 12/2017 Subhedar et al.
9,862,553 B2 1/2018 Subhedar et al.
11,136,154 B2 10/2021 Price
2001/0010199 A1 8/2001 Resta
2001/0022061 A1 9/2001 Resta
2002/0069803 A1 6/2002 Resta
2002/0092945 A1 7/2002 Resta
2002/0157584 A1 10/2002 Resta
2003/0074863 A1 4/2003 Mossbeck
2003/0079339 A1 5/2003 Gecic
2003/0213216 A1 11/2003 Harte
2004/0096303 A1 5/2004 Resta
2004/0256373 A1 12/2004 Irwin
2004/0261186 A1 12/2004 Gladney
2006/0231436 A1 10/2006 Spinks et al.
2007/0204566 A1 9/2007 Lee
2008/0229715 A1 * 9/2008 Schmidt ..... A61B 18/20 53/450
2009/0293435 A1 12/2009 Johnson
2013/0055688 A1 3/2013 Jokele
2015/0203221 A1 7/2015 Van De Hey et al.
2016/0023791 A1 1/2016 Hsu
2016/0214785 A1 7/2016 Jan
2019/0092507 A1 * 3/2019 Price ..... B65B 51/14
2019/0152631 A1 5/2019 Sireix

* cited by examiner

PACKAGING MACHINE FOR BEDDING PRODUCTS

CROSS REFERENCE TO RELATED APPLICATION

The present patent application claims the benefit of U.S. patent application Ser. No. 16/136,915, filed Sep. 20, 2018, and U.S. Provisional Patent Application No. 62/561,730, filed Sep. 22, 2017.

INCORPORATION BY REFERENCE

The disclosures of U.S. patent application Ser. No. 16/136,915, filed Sep. 20, 2018, and U.S. Provisional Patent Application No. 62/561,730, filed Sep. 22, 2017, are specifically incorporated by reference herein as if set forth in its entirety.

TECHNICAL FIELD

The present disclosure generally relates to a packaging machine for packaging products such as bedding and furniture products, and in particular to a system and method for packaging mattresses, foundations, cushions, and other similar products in a protective film or packaging material for transport and storage.

BACKGROUND

Bedding and furniture products such as mattresses, box springs, foundations, futons, cushions and other, similar products generally are shrink wrapped or otherwise wrapped in a plastic sheeting material for protection during storage and transport. Typically, a polyethylene sheeting material or similar, relatively durable plastic wrapping material or film will be used to encase the mattresses or other bedding or furniture products with the edges of the plastic sheeting material or film generally being sealed or otherwise attached together to substantially encapsulate or enclose the product therein. The plastic sheeting material generally will protect the mattresses or other products from being soiled and/or stained with liquids, dirt or other debris, as well as protect the sides and ends of the mattresses from damage during handling and storage as the mattresses are stacked and/or moved along their side or end edges.

A problem that exists with conventional packaging machines is that the set up and leveling of such machines often can be difficult to install in terms of getting the machine properly leveled for consistently airtight sealing, ensuring that the machine and the sealing elements thereof are level is important to provide a consistent, durable and substantially airtight sealing of the package. Uneven floors, manufacturing tolerances or inaccuracies, and other factors, however, can make it difficult to perfectly level out the sealing elements of the machine, often requiring substantial labor and adjustments. Still further, such machines typically are in substantially constant use, and as a result, can experience substantial wear on their components; for example, the sealing assemblies used for heat-sealing the plastic sheeting material about the mattresses, etc., can become fouled with melted plastic, or their heating elements can burn out, requiring disassembly and/or replacement and releveling.

Accordingly, it can be seen that a need exists for a system and method for packaging bedding and/or furniture products that addresses the foregoing and other related and unrelated problems in the art.

SUMMARY

In general, a packaging machine according to one embodiment of the disclosure is used for packaging a product and comprises a frame for supporting the product as the product is moved along a path of travel. A source of packaging material is positioned on the frame for supplying packaging material into a position to be at least partially engaged by and at least partially surround the product as the product is moved along the path of travel. At least one upper sealing assembly is movably mounted on the frame and is adapted to move between an actuated position and a non-actuated position. The upper sealing assembly comprises at least one sealing element for forming a seal along adjacent edges of the packaging material, which sealing element can be adapted for removal from the frame. For example, the upper sealing assembly can include a heating element that heats one or more sealing bars, and a blade to cut the packaging material after sealing. At least one lower sealing assembly is mounted on the frame in a position adapted for cooperating engagement with the upper sealing assembly in its actuated position. A series of upper and lower sealing assemblies can be positioned along the sides and one or both ends of the frame of the packaging machine and can be movable into clamping engagement with the packaging material engaged therebetween for forming the seal, e.g., when the upper sealing assembly is moved to its actuated position in engagement with the lower sealing assembly.

In addition, the lower sealing assembly generally can comprise a support, and one or more replaceable sealing elements that can be covered with an insulating and/or a nonstick surface material. In one aspect, the lower sealing element can include one or more expandable bladders, tubes, or other similar flexible and/or compressible seal members that can be received along the length of the support, and which can be expanded, inflated, or their size/configuration otherwise adjusted by control of a flow volume and/or pressure of a fluid media to the seal members. A regulating assembly can be provided to control or regulate the flow of fluid media into and/or through the support member(s). The flexible/compressible seal member(s) can flex and/or move (i.e., expand and compress) as needed to provide an adjustable counter-engaging surface against which the upper sealing element is at least partially engaged and at least partially bears against so as to substantially minimize inconsistencies or inaccuracies between the engagement of the upper and lower sealing assemblies along the length thereof. The lower sealing assembly also can further include a dispenser mechanism to provide a source or supply of nonstick sealing material as needed. A compression assembly further can be mounted on the frame for compressing the product prior to movement of the sealing assembly to the actuated position. The compression assembly generally comprises a compression bar and a first and a second actuator, respectively positioned adjacent opposite ends of the compression bar.

Various objects, features and advantages of the embodiments of the present invention will become apparent to those skilled in the art upon reading the following detailed description, when taken in conjunction with the accompanying drawings.

BRIEF DESCRIPTION OF THE DRAWINGS

It will be understood that the drawings accompanying the present disclosure, which are included to provide a further understanding of the present disclosure, are incorporated in and constitute a part of this specification, illustrate various aspects, features, advantages and benefits of the present disclosure, and together with the following detailed description, serve to explain the principals of the present disclosure. In addition, those skilled in the art will understand that, accordingly, in practice, various features of the drawings discussed herein are not necessarily drawn to scale, and that dimensions of various features and elements shown or illustrated in the drawings and/or discussed in the following Detailed Description may be expanded, reduced or moved to an exploded position in order to more clearly illustrate the principles and embodiments of the present disclosure as set forth herein.

Corresponding parts are designated by corresponding reference numbers throughout the drawings.

DETAILED DESCRIPTION

Figure 1A:
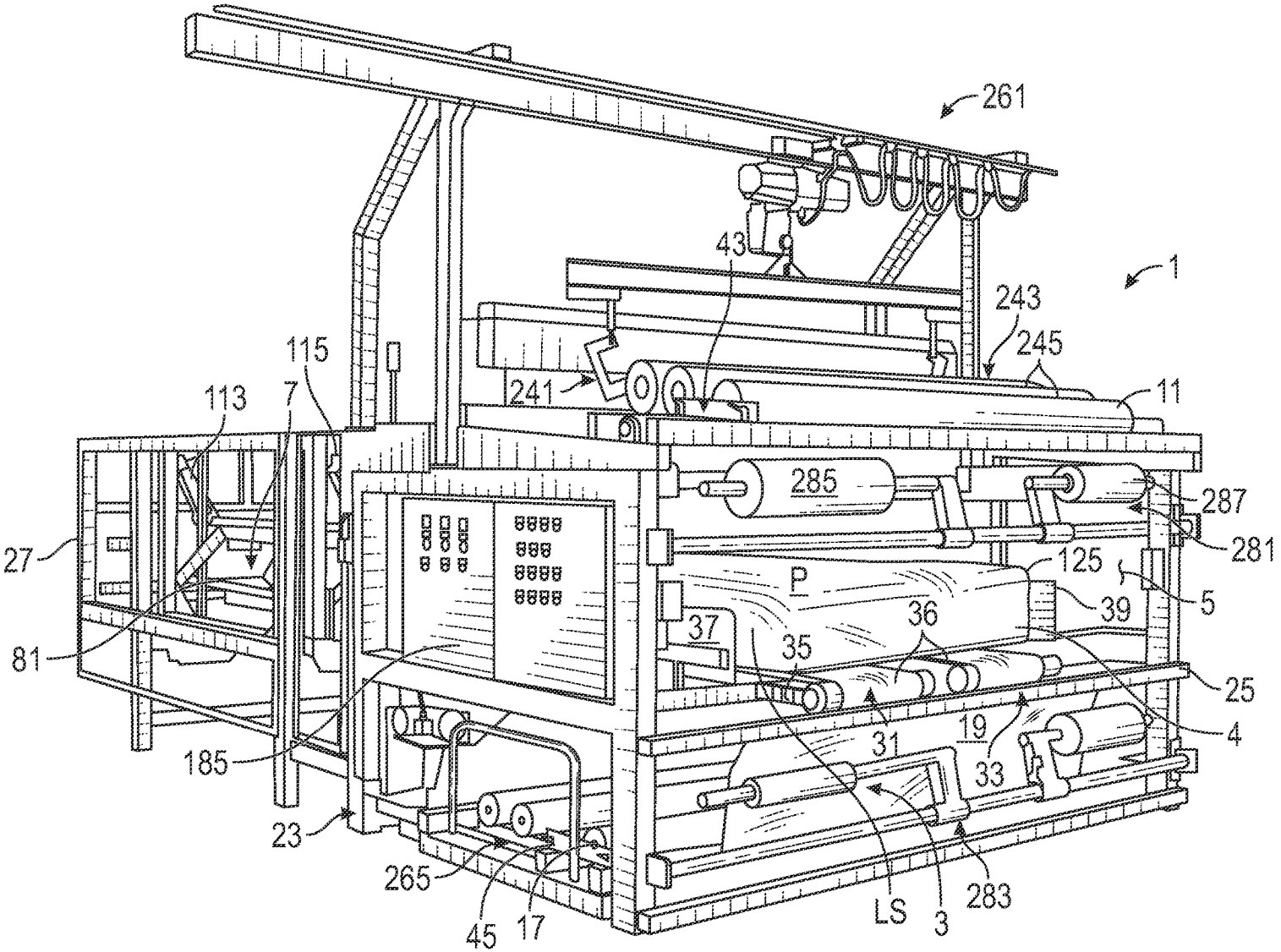
FIG. 1A is a perspective view of a packaging machine according to the principles of the present disclosure.

As shown in the drawings, the present disclosure generally relates to a packaging machine, generally designated at 1, for packaging various types of products P in a packaging material such as plastic sheeting, wrapping material, film, and/or other suitable composite or synthetic packaging material generally indicated at 3. The packaging machine 1 according to the exemplary embodiments present herein can be used for packaging bedding products P, such as mattresses, box springs or foundations, futons, cushions and/or foam padding, although it will be understood by those skilled in the art that various other types of products including furniture and other similar bulky products also can be packaged using the system of the present disclosure. Accordingly, while the term "mattress" will be used to describe the product P being packaged in an exemplary embodiment of the present disclosure as discussed hereinafter, it will be understood that the present disclosure should not be limited solely to the packaging of mattresses, but also can be used for other bedding, furniture, and/or other, similar products as well. In addition, the packaging machine can include various features and/or configurations, including as shown in U.S. Pat. No. 7,583,676 B1, the disclosure of which is incorporated by reference as if set forth herein in its entirety.

In one example, as generally shown in FIGS. 1A-2B, the packaging machine 1 can have a front product receiving area, generally indicated at 5, at the front of the machine for receiving a product P to be packaged, and a packaging area, generally indicated at 7, toward the rear of the machine 1 for enclosing and sealing the product in the packaging material 3. The packaging machine 1 will have a supply or source of a packaging material or film, for example, a plastic sheeting or other suitable packaging substrate 3. The packaging material is not limited to plastic sheet or film materials, however, and can comprise various other flexible, heat-sealable packaging materials, including composites, synthetic, or other suitable materials, or combinations thereof. The supply of packaging material can include an upper roll 11 of packaging material at the top of the machine for supplying an upper web 13 of packaging material to the packaging area 7 and a lower roll 17 of packaging material at the bottom of the machine for supplying a lower web 19 of packaging material to the packaging area of the machine. The packaging machine 1 also generally includes a frame, generally indicated at 23, that typically is constructed of a high strength material such as steel or similar materials, the frame defining an input end 25 at product receiving area 5 at the front of the machine and an output end 27 at the end of the packaging area 7 at the rear of the machine.

As indicated in FIGS. 1A-2B, the product receiving area 5 has at least one and can have two or more conveyors 31, 33 spaced apart on the frame 23 for receiving an unpackaged product P from the input end 25 and moving the product along a path of travel through the product receiving area. The packaging area 7 similarly can have two conveyors 32, 34 (FIG. 1B) spaced apart on the frame 23 for receiving the product from the product receiving area 5 and moving the product along a path of travel through the packaging area 7 to the output end 27 of the machine 1. As also shown in FIGS. 1A and 1B, each conveyor 31, 33 can comprise a belt 36 movably mounted on a product receiving surface of the frame 23 and a rail 35 for supporting the belt on the product receiving surface. The rails 35 generally are formed from a low friction material and are positioned between the belt 36 and the product receiving surface of the frame 23 so that the belt is positioned above the product receiving surface sufficient to maintain the belt above the produce receiving surface when a load is placed thereon to help maintain the traction of the belts so that the belts can more readily move products, including products that may be warped, curved or otherwise configured.

It also is understood that belts 36 may be flush with the product receiving surface or that the belt may be spaced above the product receiving surface by other dimensions. In the illustrated embodiment, the conveyors 32 and/or 34 of the packaging area 7 also can be of similar construction as the conveyors 31, 33 of the product receiving area 5 of the machine except that the conveyors in the packaging area have belts 38 mounted along the product receiving surface. The belts 38 (FIG. 1B) in the packaging area 7 may be formed from a thicker material that more readily grasps the product than the belts 36 in the product receiving area 5. The belts 36 in the product receiving area 5 can be thinner than the belts 38 in the packaging area 7 to allow the product P to be moved laterally in the product receiving area to properly position the product in the product receiving area. It further is understood that the conveyors 31, 33 and 32, 34 may include other types of material moving apparatus having other configurations without departing from the scope of this disclosure.

Figure 1B:
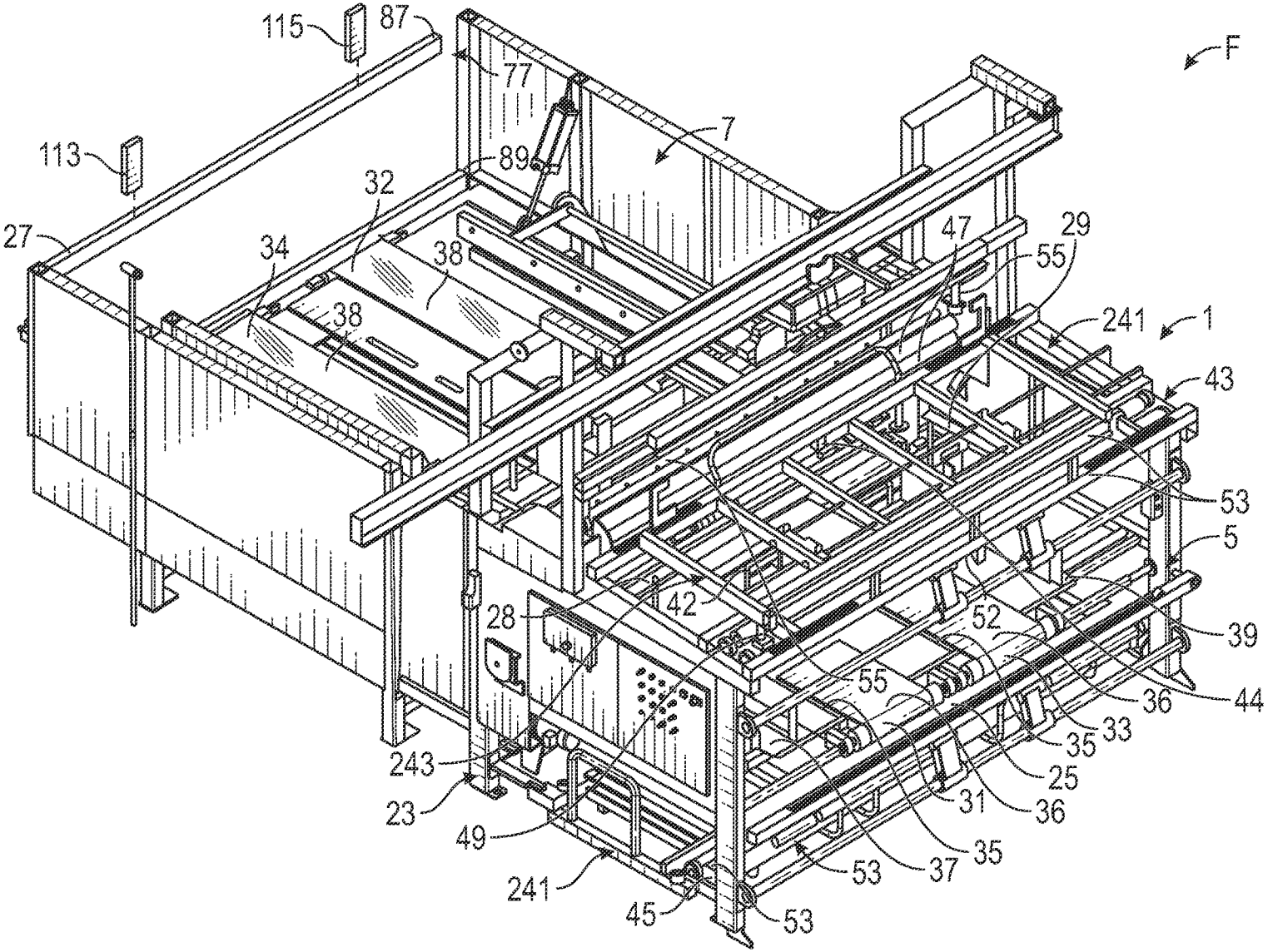
FIG. 1B is a top perspective view of a packaging machine.

Guides 37, 39 generally are provided along a respective side of the mattress receiving area 5 as generally shown in FIGS. 1A and 1B. One of the guides (e.g., the left side guide 37) can be movable along or across the frame 23, while the other guide (e.g., the right side guide 39) can be mounted on the frame in a fixed position. In the illustrated embodiment, left side guide 37 can be movable toward and away from the right side guide 39 for lateral positioning of the product P (FIG. 1A) in the product receiving area 5 of the machine 1. The movable guide 37 can help position the product P against the other, fixed guide 39 to place it in a proper or desired alignment or orientation for packaging. In the illustrated embodiment, each of the guides 37, 39 is an elongated plate, generally formed from steel or similar material, along which the side edges of the mattress P will pass as the mattress is moved along the path of travel through the product receiving area 5 to the packaging area 7 of the machine 1. The movable guide 37 has a sensor 28 attached to the guide at a location above the guide and positioned to detect when the movable guide contacts the product P. The fixed guide 39 has a sensor 29 attached to the guide at a location above the guide and positioned to detect when the product P has been positioned against the fixed guide. In the illustrated embodiment, the sensors 28, 29 are visible light photo sensors operable to detect when the beam of light is interrupted by the positioning of the product P against or immediately adjacent the guides 37, 39. It will be understood that the sensors 28, 29 can include other types of sensors or detectors without departing from the scope of this disclosure.

The movable guide 37 generally is moved toward and away from the fixed guide 39 through the use of a drive mechanism (not shown), such as a servomotor, or pneumatic cylinder that may be operatively connected to the movable guide and located below the conveyor 31 in the product receiving area 5. A gate 42 (FIG. 1B) can be positioned at the downstream end of the product receiving area 5 and is rotated into the path of travel of the product P to stop further movement of the product upon activation by a sensor 44 (FIG. 1B). The sensor 44 can be mounted on the frame 23 at a location above the gate 42 and is generally centered between the left and right sides of the machine 1 toward the downstream end of the product receiving area 5. If the product P (FIG. 1A) is misaligned in the product receiving area 5 such that the downstream end D of the product P is not parallel to the gate 42, the sensor 44 may not recognize that the product has been loaded in the product receiving area and packaging of the product can be temporarily halted as the produce is realigned.

Upon detection of the downstream end D of the product P in the product receiving area 5, the sensor 44 also activates the movable guide 37 which moves laterally across the product receiving area to contact the left side LS of the product P so as to urge the product in the lateral direction against the fixed guide 39, with the sensor 28 detecting that the mattress has been contacted, and as the product P is urged against the fixed guide 39, the sensor 29 detects that the product P is correctly positioned against the guide 39 in the product receiving area 5 of the machine. To prevent damage to the machine 1 or the product P, the drive initiating movement of the movable side guide 37 can be deactivated upon detection that the product has been stopped from further lateral movement by the fixed side guide 39. Once the three sensors 28, 29, 44 have detected the correct positioning of the product P in the product receiving area 5, the gate 42 is rotated out of the path of travel of the product to allow the product to pass into the packaging area 7 of the machine 1.

The upper and lower rolls 11, 17 of a packaging material are rotatably received within respective upper and lower cradles, generally indicated a 43, 45, mounted above and below the product receiving area 5 of the packaging machine 1 (FIG. 1A). In the illustrated embodiment each cradle 43, 45 comprises a respective pair of cradle rollers 53 mounted on the frame 23 and spaced apart to receive a respective upper and lower roll 11, 17 therebetween. The cradle rollers 53 are free to spin on the frame and are in contact with the upper and lower roll to allow the respective upper and lower roll 11, 17 to spin in the cradle as packaging material 3 is fed from above and below the product receiving area 5 into the packaging area 7 for application to the product P. The webs 13, 19 of packaging material 3 of each roll 11, 17 generally are a polyethylene or similar plastic film typically approximately 1.25 mil to approximately 4 mil in thickness, although other materials having greater or lesser thicknesses of the packaging material also can be used as will be understood by those skilled in the art. In the illustrated embodiment, one cradle roller 53 of each pair of cradle rollers has a brake 49 mounted near an axial end of the roller.

The brake 49 generally comprises a brake pad (not shown) mounted to an actuator (i.e., a solenoid, a pneumatic, hydraulic, cylinder or the like), that is pressurized to apply a drag force on the cradle roller 53 during operation of the machine 1, to prevent overfeed of the packaging material 3 from the respective upper and lower rolls 11, 17 by the application of the drag force to the respective cradle roller 53. As shown in FIG. 1B, the brake 49 generally is located adjacent the upstream cradle roller 53 of each pair of cradle rollers, though it is understood that the brake may be otherwise positioned and may be otherwise configured to include other mechanisms for producing the drag force on the cradle roller without departing from the scope of this disclosure.

In one embodiment, the machine 1 also can have an upper pair of pinch rollers 47 (FIG. 1B) at the top of the product receiving area 5 receiving the upper web therebetween and a lower pair of pinch rollers mounted at the bottom of the product receiving area and receiving the lower web 19 therebetween. Each of the pinch rollers can be covered by a friction increasing material (e.g., neoprene) for frictional engagement and movement of each of the webs 13, 19 between the pairs of pinch rollers. At least one of each pair of pinch rollers can be driven by a motor (not shown) so the webs 13, 19 of material are pulled by the pinch rollers and delivered from the respective upper and lower roll 11, 17 of packaging material to the packaging area 7 of the machine. In the illustrated embodiment, one pinch roller of each pair of pinch rollers 47 also can have a lifting mechanism (broadly "pinch roller adjustment mechanism") 55 mounted on the top roller of each pair of rollers near each axial end of the roller. The lifting mechanism 55 allows the top roller of each pair of pinch rollers 47 to be lifted above the bottom roller by a distance sufficient to allow adequate space to readily feed the upper and lower webs 13, 19 of packaging material 3 between the pinch rollers. The lifting mechanism 55 may be actuated by the operator to automatically lift the upper pinch roller 47 to increase the space between the upper and lower pinch rollers when a roll of material 11, 17 is empty or when the upper or lower web 13, 19 of packaging material must be positioned to remove a fold or pleat from the web. It is understood that the pinch rollers 47 further may have other configurations without departing from the scope of this disclosure.

Figure 3:
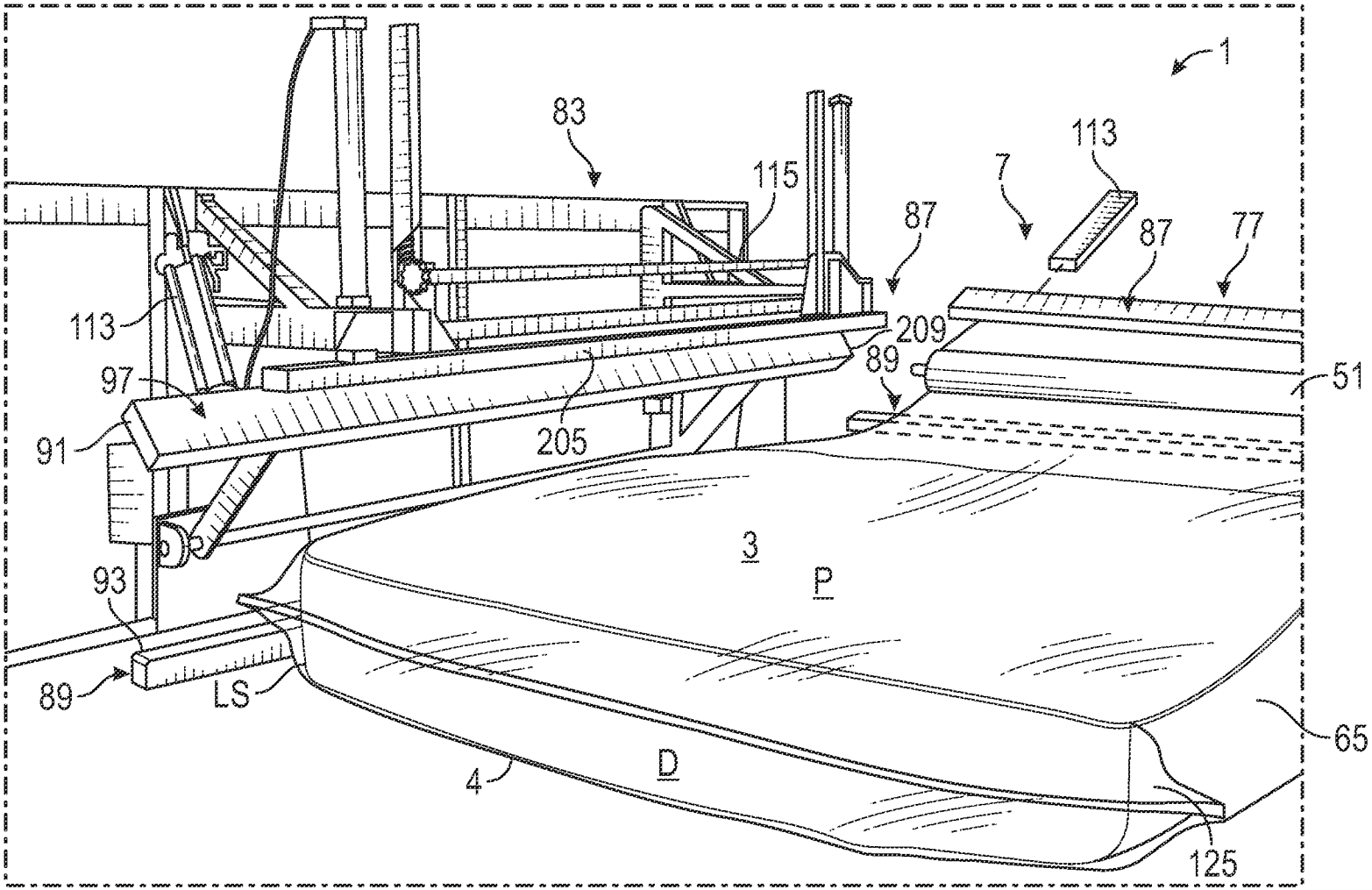
FIG. 3 is an enlarged partial perspective view of a packaging area showing a product loaded in the machine.

As partially illustrated in FIG. 3, a tension roller 51 typically will be positioned above the upper surface of the product P, such as a mattress, and will be movable into engagement with the upper surface of the product as the product is moved through the packaging area 7 and packaged in the machine 1. A pivot mechanism, such as one or more pneumatic cylinders (not shown) can be attached to the tension roller 51, for moving the tension roller 51 to a position pressing the plastic packaging material 3 or sheeting against the upper surface of the product P such as a mattress is pushed through the packaging material so as to substantially reduce the amount of slack in the plastic packaging material and ensure an essentially tight, compact package.

As discussed in more detail below, the upper and lower webs 13, 19 can be bonded together at the upstream end of the packaging area 7 prior to the entry of a mattress or other product P into the packaging area. When the mattress P is moved into the packaging area 7 the drive roller of each pair of upper and lower pinch rollers 47 feeds the webs 13, 19 of material into the packaging area 7 as the mattress is moved along its path of travel so that the upper web 13 covers the top of the mattress P while the bottom web 19 covers the bottom of the mattress, the upper and lower webs 13, 19 thereafter being joined so that the downstream end D of the mattress P presses against the bonded webs. Air jets can be positioned along the side of the path of travel in the packaging area 7 to direct flows of air under pressure along the left side LS of the mattress and the right side RS of the mattress to separate and keep the webs 13, 19 of packaging material from clinging to the mattress or being caught or pulled prior to sealing. As the mattress P is fully advanced into the packaging area 7, each of the upper and lower webs 13, 19 of packaging material also can have a marginal or edge portion that extends from the upstream end U and sides LS, RS of the mattress P.

Figure 2A:
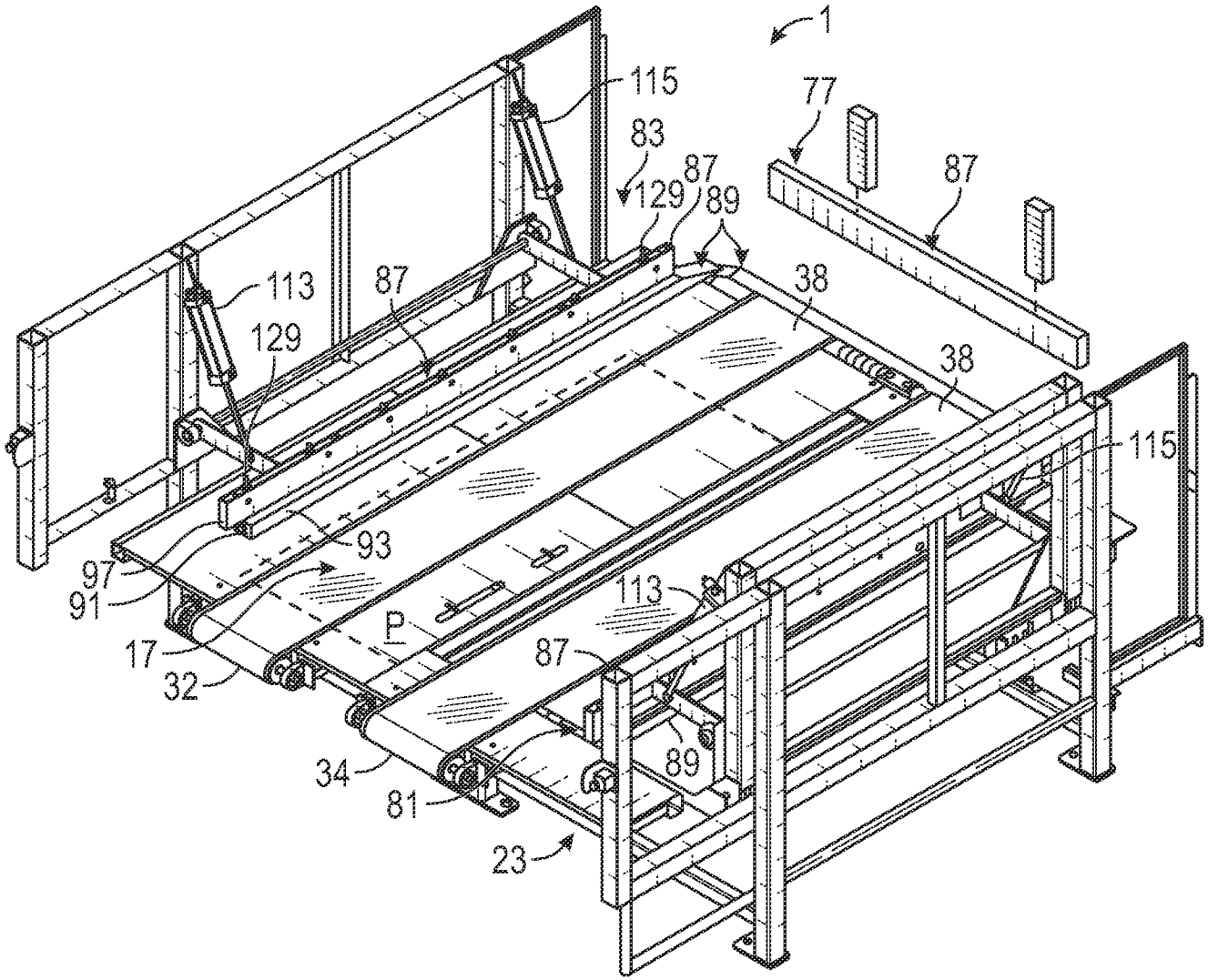
FIG. 2A is a perspective view of the packaging area of a packaging machine.
Figure 2B:
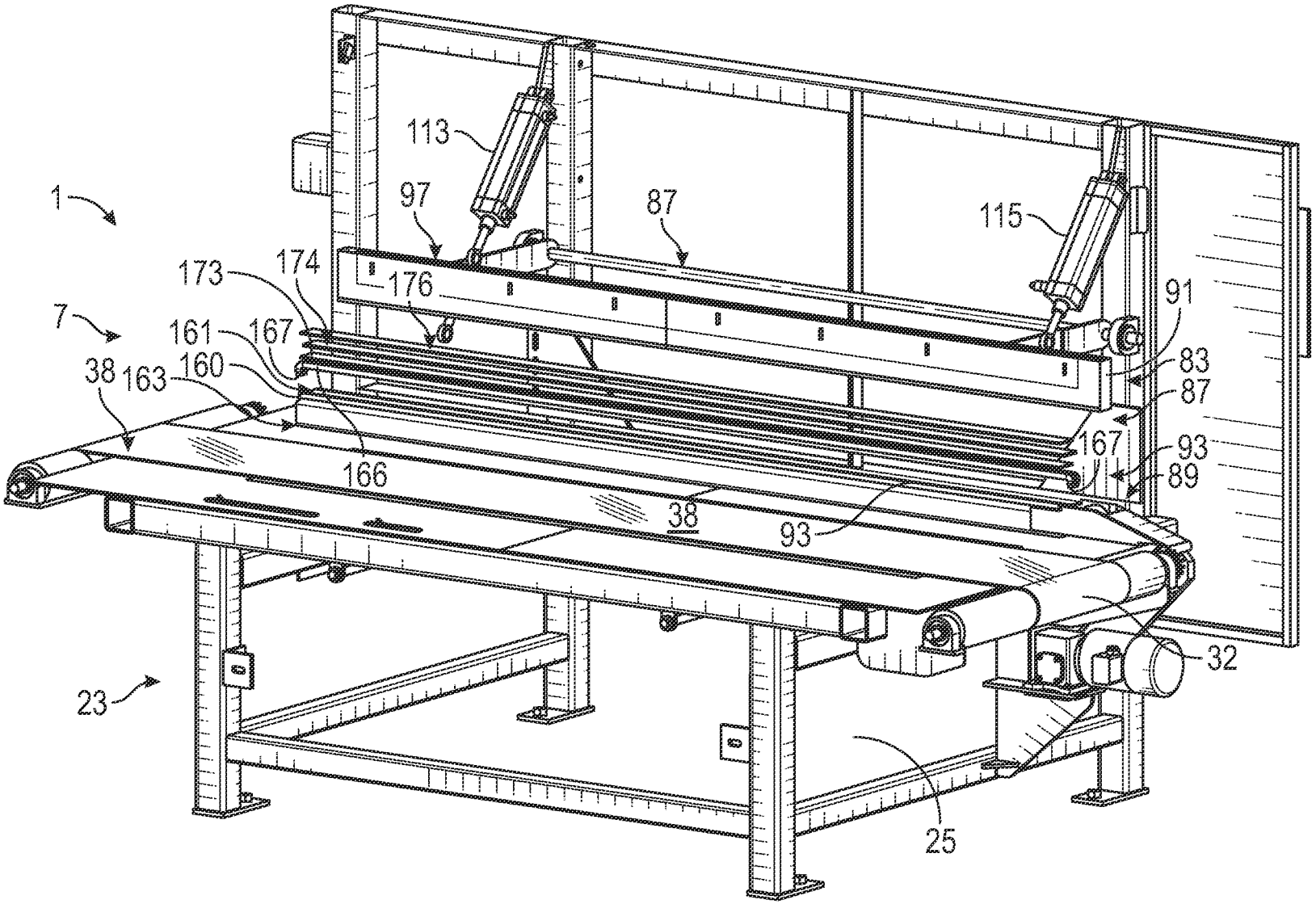
FIG. 2B is a partial perspective view of a packaging machine showing a packaging area of the machine.
Figure 4:
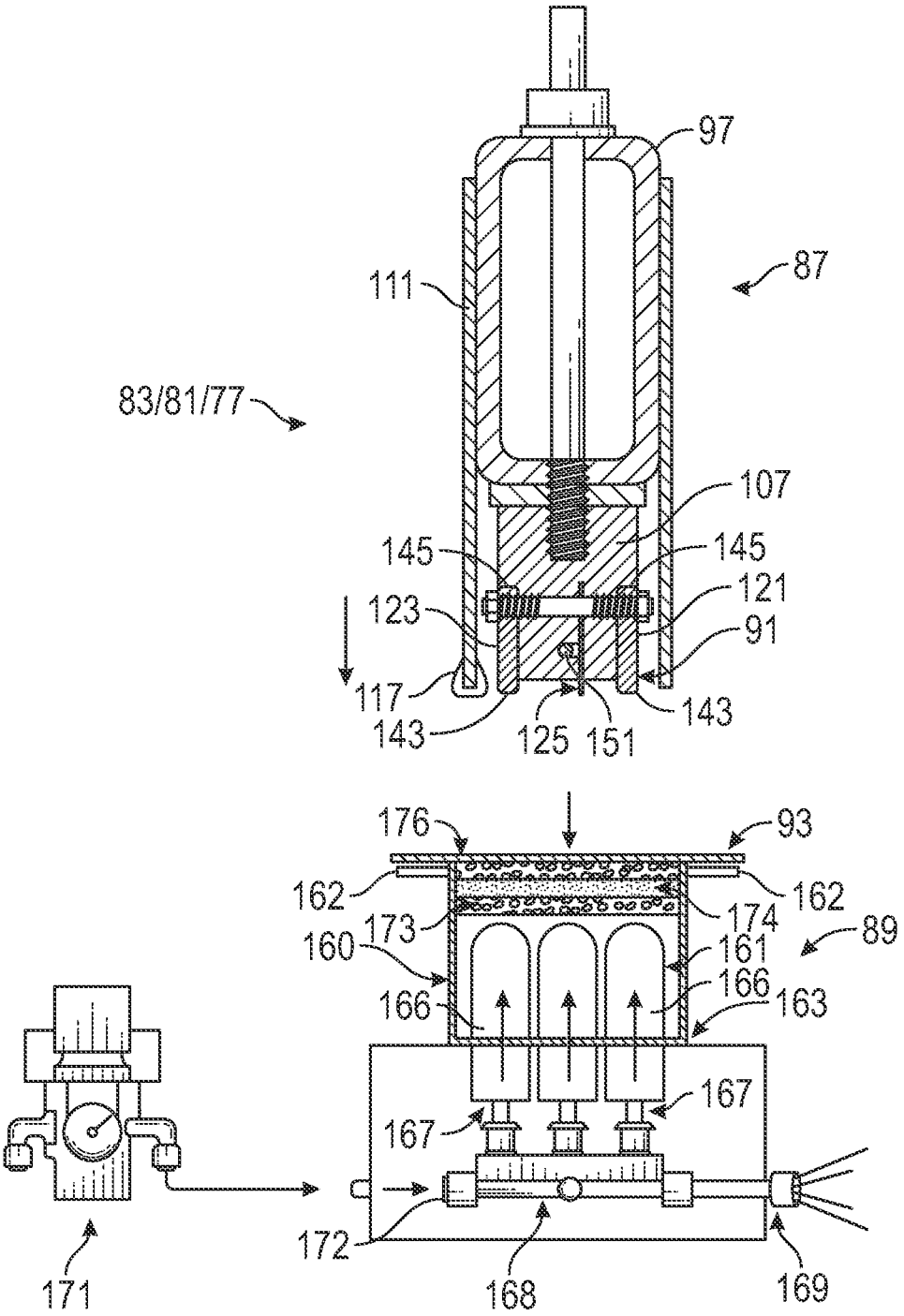
FIG. 4 is an end view taken in partial cross-section, showing an upper and lower sealing assembly of a packaging machine.

To form seals along the packaged product or article P (i.e., a mattress), the packaging machine 1 can include an end and a pair of side sealing assemblies, generally designated at 77, 81 and 83 (FIGS. 2A-2B). The end sealing assembly 77 can be positioned at the upstream end of the packaging area 7 for sealing the marginal portions of the webs at the upstream end of the mattress, while left side sealing assembly is positioned along the left side of the packaging area for sealing the marginal portions of the webs along the left side of the mattress, and the right side sealing assembly 83 is positioned along the right side of the packaging area for sealing the marginal portions of the webs along the right side of the mattress. In the illustrated embodiment, the end sealing assembly 77 and the left and right side sealing assemblies 81, 83 each include an upper sealing assembly, generally designated 87, which is movably mounted on frame 23; and a lower sealing assembly, generally designated at 89, which is positioned for cooperative engagement with the upper sealing assembly. The upper and/or lower sealing assemblies 87, 89 can have one or more sealing elements 91, 93 for the application of heat to the respective marginal portions of the upper and lower webs 13, 19 of packaging material to form a thermal bond (seal) between the upper and lower webs around the respective downstream side, upstream side, left side, and right side of the mattress as generally shown in FIG. 4. In this way, a seal is formed at each of the four sides of the mattress so that the mattress is enclosed in the packaging material and sealed in a protective covering or package.

After the mattress is fully advanced into the packaging area 7, the end sealing assembly 77 is operated to form a thermal bond between the upper and lower webs 13, 19 of packaging material that forms the seal at the upstream end U of the mattress that is received in the packaging area. In the illustrated embodiment, the end sealing assembly 77 also cuts the upper and lower webs 13, 19 of material and forms a second thermal bond between the upper and lower webs that serves as the seal that connects the upper and lower webs at the inlet of the packaging area 7 which forms the seal at the downstream end D of the next mattress to be packaged in the machine 1. In this way, the end sealing assembly 77 can simultaneously form the thermal bond at the upstream end U of the mattress P loaded in the packaging area and the thermal bond at the downstream end D of the next mattress to be packaged in the machine 1. As will be discussed in more detail below, the end sealing assembly 77 applies heat to the first and second webs 13, 19 of heat bondable packaging/sheeting material 3 so as to bond the webs of packaging material together along a heat-sealed seam. Thereafter, the left side sealing assembly 81 and the right side sealing assembly 83 may be operated simultaneously in a similar fashion to form the heat-sealed edge along the respective left and right sides LS, RS of the mattress. It is understood that the left side sealing assembly 81 and the right side sealing assembly 83 could be operated sequentially without departing from the scope of this disclosure. Any excess material of the upper and lower webs 13, 19 of packaging material on the outer periphery of the left and right heat sealed edges may be cut away and discarded. The completed, packaged mattress then is passed out of the packaging machine 1 of the present disclosure through the output end 27 thereof for storage and transport.

The upper sealing assembly 87 (FIGS. 2A-3) and lower sealing assembly 89 of the end and side sealing assemblies 77, 81 and 83 generally can have substantially similar constructions. As shown in FIG. 4, each upper sealing assembly 87 generally comprises a support 97 movably mounted on the frame 23, and with one or more heating elements 122/123 mounted thereto. The upper sealing assembly 87 is movable from its raised position to an actuated position by actuators, such as solenoids, motors or air cylinders 113, 115 mounted adjacent to respective ends of the sealing assembly. In the illustrated embodiment, an inwardly located guard plate 111 can be attached to support 97, with a shield 117 mounted along a lower edge of the guard and extending lengthwise. The shield 117 may be made from silicon or other suitable material that protects the edge of the guard 111 and prevents adhesion of the packaging material 3 to the guard. Alternatively, the shield 117 may be replaced with a bend at the lowermost edge of the inwardly located guard 111 that provides a blunt, rounded surface to generally flatten and clamp the packaging material 3 at the sides of the upper sealing assembly 87 adjacent to the mattress P prior to sealing by the upper and lower sealing assemblies 87, 89. The sealing elements or seal bars 121, 123 can be supported by a bracket 107 that can be attached to the support 97 by threaded rods 129, including rods of different lengths extending through top and bottom walls of the support to accommodate for thermal expansion between the mounting bracket 107 and the support 97.

As shown in FIG. 4, the seal bars 121, 123 and cutting blade 125 can be received in a notch defined in the mounting bracket 107 and are attached to the mounting bracket. In one embodiment, the seal bars 121, 123 can be attached to the mounting bracket 107 at spaced apart locations and a cutting blade 125 can be attached at a position between the seal bars. It is understood that the seal bars 121, 123 and cutting blade 125 also could be otherwise positioned or that more or less than two seal bars and more or less than one cutting blade may be attached to the mounting bracket 107 without departing from the scope of this disclosure.

The seal bars 121, 123 each have a first sealing surface 143 along the exposed longitudinal edge of the seal bar and a second sealing surface 145 along the opposite longitudinal edge of the seal bar that is received in the mounting bracket. In the illustrated embodiment, each seal bar 121, 123 is reversibly mounted on the mounting bracket 107 so that each seal bar may be removed from the position shown in FIG. 4 and reattached to the mounting bracket so that the second sealing surface 145 is exposed for engaging the packaging material 3. In the illustrated embodiment, should the first sealing surface 143 of the seal bar 121, 123 become fouled or otherwise corrupted with packaging material 3, the seal bar can be quickly and easily reversed to expose the second sealing surface 145 for use in sealing the packaging material. It also will be understood that the seal bars 121, 123 and the cutting blade 125 can comprise or be covered with a nonstick material to prevent adhesion of the packaging material 3 to the respective element. For example, the seal bars 121, 123 and cutting blade 125 have a Teflon® coating applied by conventional material deposition techniques to the outer surfaces of the seal bars and cutting blade but it is understood that the seal bars and cutting blade may have other nonstick materials applied by other methods such as a Teflon® tape applied to the external surface of each of the seal bars and the blade.

A heating element 151, such as an electrical resistance heater can be received in the mounting bracket 107 adjacent the cutting blade 125. The heating element 151 can heat the mounting bracket 107, cutting blade 125, and/or the seal bars 121, 123 of the upper sealing assembly 87 so that heat is delivered to the upper and lower webs 13, 19 of packaging material 3 when the upper sealing assembly is moved to the actuated position. One suitable heater for use in the upper sealing assembly is an electric resistance seal bar heater, though it is understood that other types of heaters may be used without departing from the scope of this disclosure. The upper sealing assembly 87 further may have a variety of different configurations which are designed to provide varying types of seals, as well as providing varying arrangements that enable quick and easy repair or replacement of the seal bar(s) 121, 123 and/or cutting blade 125 and/or without requiring substantial replacement of the entire upper sealing assembly. The upper sealing assembly 87 also may include seal bars having one or more sealing edges so that each seal bar forms two spaced apart seals in the corresponding edge margins of the packaging material. It is understood that the dual sealing edge design could also include corresponding dual lips on the opposite longitudinal sealing surface of the seal bars without departing from the scope of this disclosure. In addition, the cutting blade 125 can be notched as needed or desired to form a perforated cut in the plastic packaging material 3.

The air cylinders of the upper sealing assembly each have a brake mechanism in the form of a lockout valve or check valve mounted on the cylinder to prevent the flow of air from the cylinder when the air supply to the machine 1 is turned off. When the upper sealing assemblies are raised, each cylinder is pressurized and filled with air and when the packaging machine 1 is turned off, the lockout valve prevents the air in each cylinder from leaking and the air cylinder pressure from reducing to a level where the upper sealing assembly is lowered. Without the lockout valves, when the power is turned off, the compressed air in the cylinders would leak over time and the upper sealing assemblies would drop when the air pressure in the cylinders is reduced to a pressure that no longer maintains the upper sealing assembly in the raised position.

Figure 5:
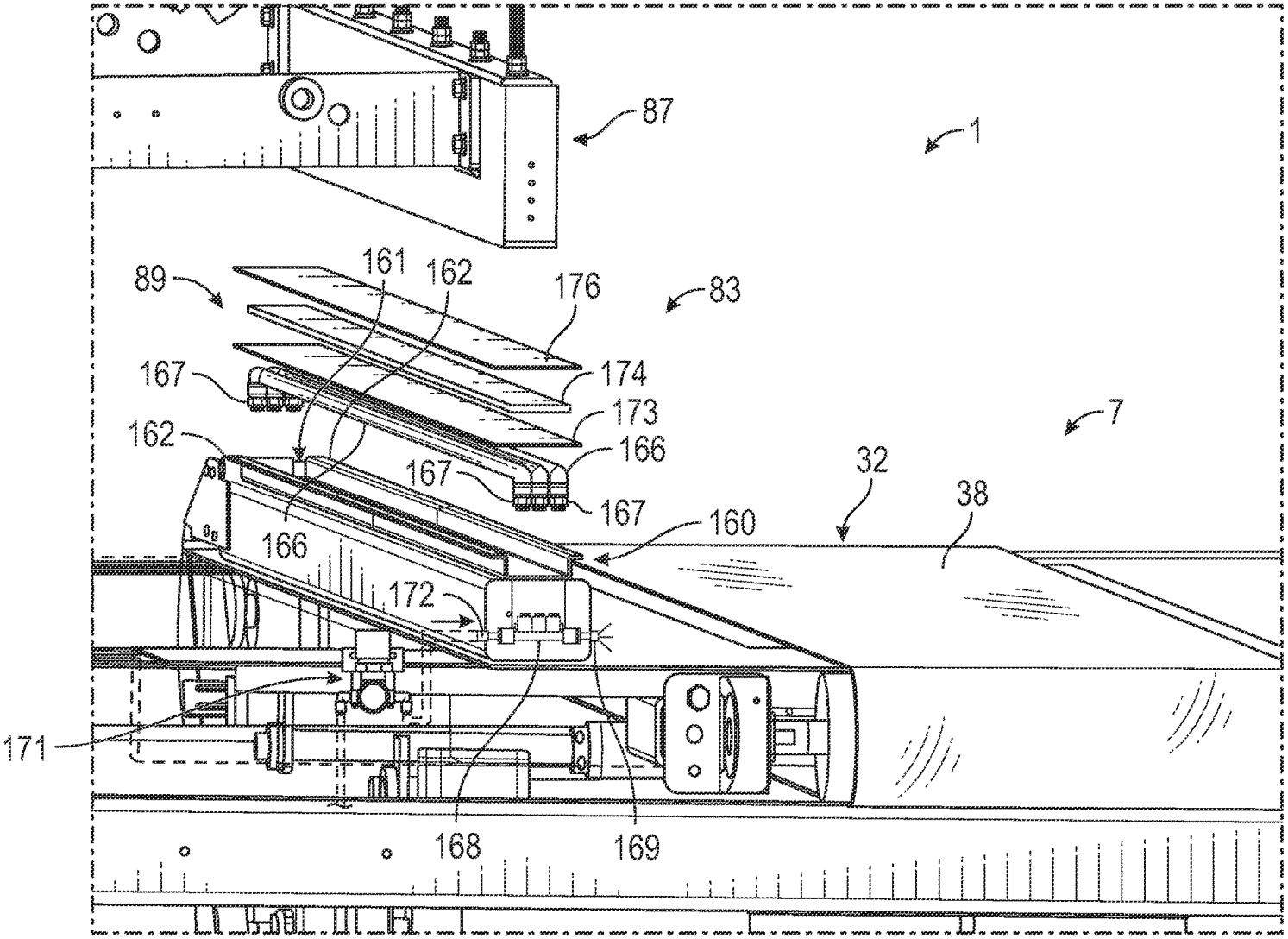
FIG. 5 is an exploded partial perspective view of a lower sealing assembly along the packaging area.
Figure 6A:
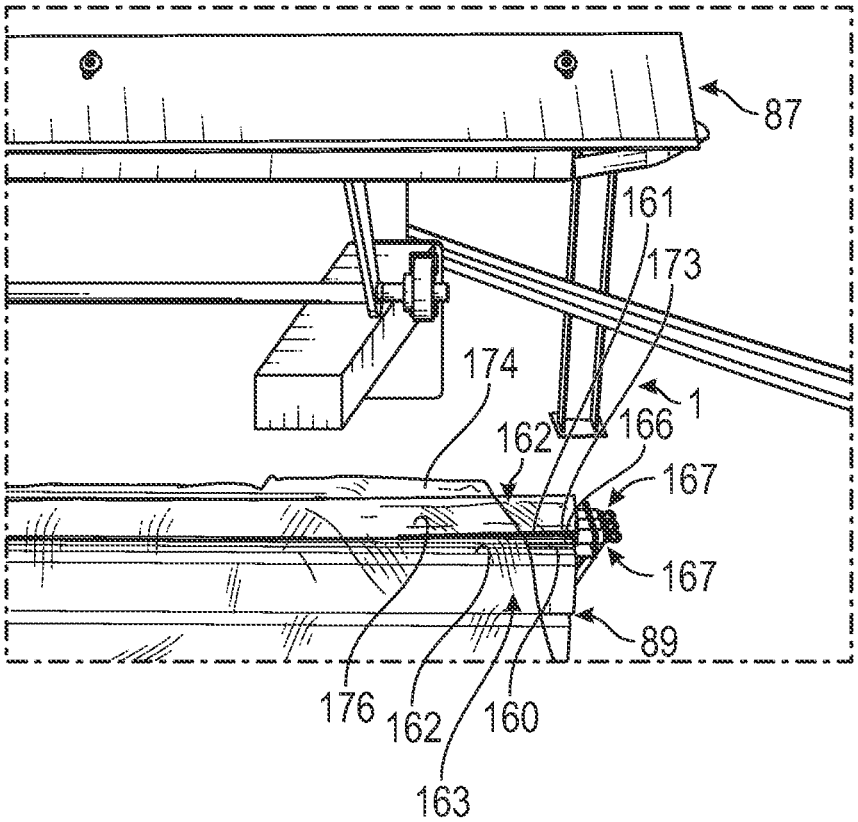
FIGS. 6A-6B are side elevational views of the upper and lower sealing assemblies.
Figure 6B:
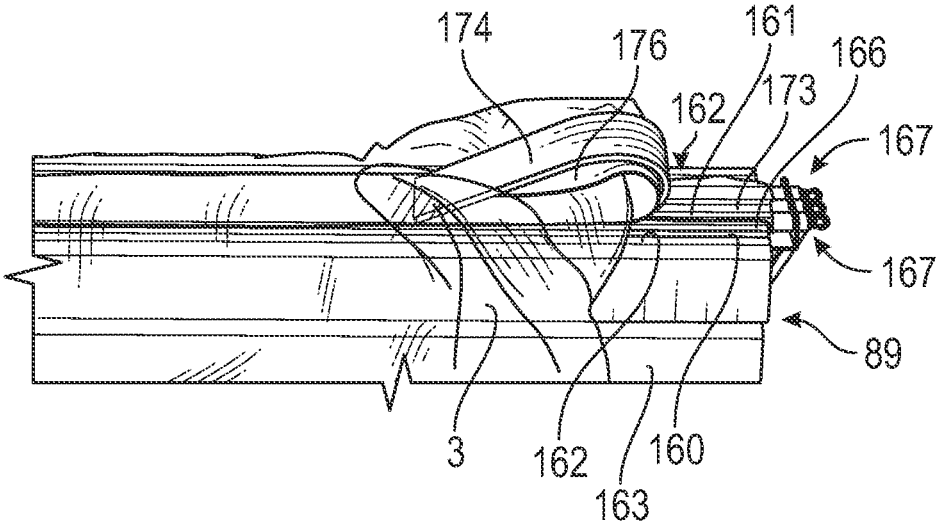
Figure 6C:
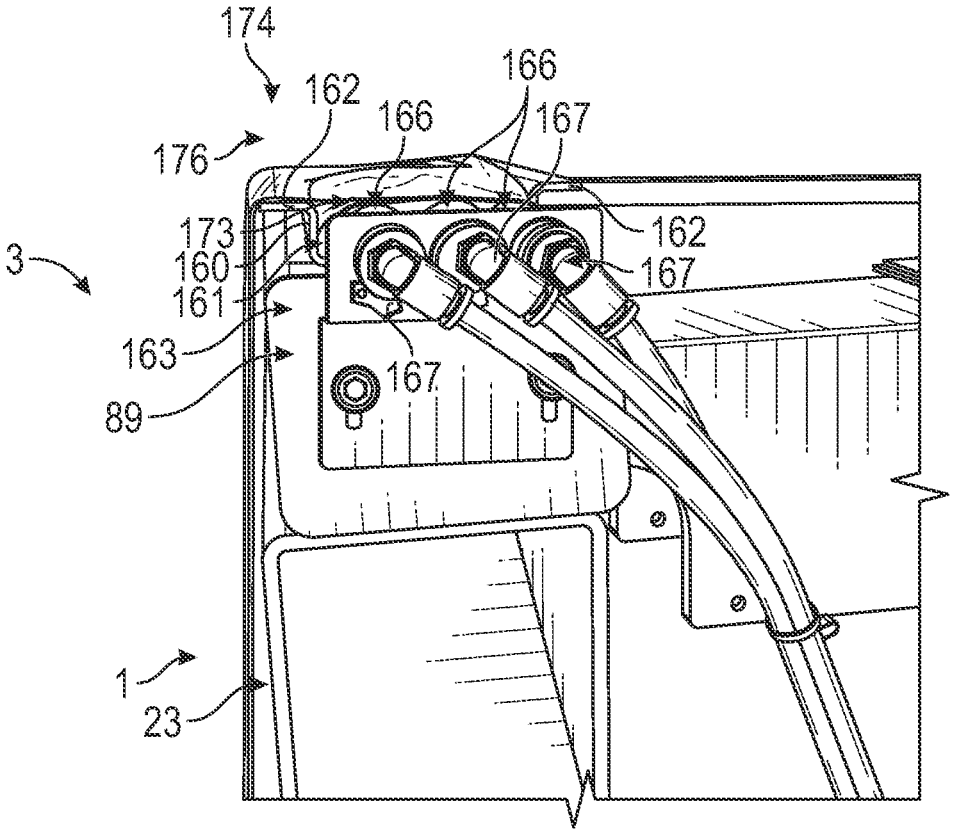
FIG. 6C is an end view of the sealing assemblies of FIGS. 6A-6B.

As generally illustrated in FIGS. 2B and 4-6C, each lower sealing assembly 89 generally will be aligned with and located below a corresponding upper sealing assembly 87 so that as the upper sealing assemblies are lowered, the edges of the plastic sheeting webs or film will be engaged therebetween for sealing. Each of the lower sealing assemblies 87, generally can include a support 160 that can be formed as a substantially U or C shaped channel defining a trough or recess 161 extending therealong, and, in some embodiments, further including outwardly extending or projecting flanges or side surfaces 162. The support 160 further can be mounted on a frame member or support bar 163. Lower sealing elements 93 are located along the trough or channel, and can include one or more flexible or compressible tubes, bladders or other similar members 166, as indicated in FIGS. 2B, 4 and 5.

In the illustrated embodiment, a series of three tubes, bladders or other compressible or expandable sealing members/elements are illustrated, though it will be understood by those skilled in the art that fewer or greater numbers of such sealing members/elements 166 (i.e., 1, 2, 4, 5, etc.), can be used depending on the application, for example for packaging larger or smaller items including, but not limited to, furniture or bedding products such as mattresses, box springs, etc. Although the compressible bladders/tubes 166 are generally shown in use, as part of the lower sealing assemblies 87 in FIGS. 2B, 4, 5, 6A-C, and 7, additionally, or as a further alternative arrangement, the bladders/tubes 166, and the components/mechanisms associated therewith, can be a part of the upper sealing assemblies 89 or can otherwise be utilized at other suitable locations or positions along the machine 1. For example, the upper and lower sealing assemblies 87/89 can be interchangeable or reversible, i.e., the components of the upper sealing assembly can be used in the lower sealing assembly and vice versa; or both the upper and lower sealing assemblies can include one or more bladders/tubes 166 without departing from the present disclosure.

Each of the sealing tubes or bladders generally will be formed from a flexible, substantially air tight material and will have a length substantially spanning the length of their lower sealing assembly. Fluid couplings 167 (FIG. 4) generally will be coupled to each end of the sealing tubes 166, and further generally will be connected to a fluid supply line or conduit 168. The sealing tubes can be inflated or expanded to a desired pressure upon receiving air, hydraulic fluid or other fluid media therein so as to cause the sealing tubes or bladders to be inflated or expanded to a desired pressure. Typically, the sealing tubes will be inflated to less than a full pressure so as to enable compression or deformation of the sealing tubes as the upper sealing assembly is pressed into engagement therewith. As further indicated in FIG. 4, conduit 168 can have an outlet or release valve 169 at a downstream portion thereof, which can control selective bleeding off or release of fluid from the sealing tubes as needed to substantially prevent over-filling or expansion of the sealing tubes. As further shown in FIGS. 4 and 5, a regulator 171 is provided substantially adjacent or substantially proximate to each lower sealing assembly and will be connected to or otherwise in communication with a supply of a fluid media such as air, hydraulics or other fluids. The regulator 171 is operable to regulate the flow of the fluid media into the upstream or inlet 172 of the fluid supply conduit 168 that supplies the fluid media to each of the sealing tubes 166. The regulator 171 further can be set to a desired pressure, for example about 8 psi to about 10 psi, although greater or lesser pressures can be used, and the pressure further can be adjusted or varied as needed depending upon the size and/or application of the sealing tubes.

As further illustrated in FIG. 5, the sealing tubes or bladders 166 typically can be covered with an insulating material to protect the sealing tubes or bladders from direct application of heat from the upper sealing elements or bars as the upper sealing elements or bars are urged into or pressed against the sealing tubes. For example, in one embodiment, a PTFE (Teflon®) tape or other similar non-stick, heat resistant material 173 can be applied directly over the length of the sealing tubes, as indicated in FIG. 5. One or more layers of a compressible insulating material 174 also can be arranged along the heat resistant material layer 173 (e.g., a silicone sponge or other, compressible insulating material), which insulating material 174 further can be covered with an additional, upper layer of a non-stick material such as a Teflon® tape or other, similar heat resistant and non-stick material 176. The upper layer of the non-stick heat resistant material 176 also can be at least partially applied over the side flanges 162 of the support 160 so as to substantially overlap the sealing tubes extending over and being supported by the side flanges of the support 160, as indicated in FIG. 4. As a result, the sealing tubes or bladders are substantially protected from direct application of heat thereto and/or engagement of the cutting blade 125 thereagainst during a sealing operation.

The compressible and flexible nature of the sealing tubes or bladders 166 further helps to facilitate sealing or engagement of the upper sealing elements thereagainst in a substantially airtight, bearing engagement, which can accommodate or adjust for inaccuracies in the position of each of the upper and lower sealing assembles. For example, with the packaging machines where the sealing elements may not be set up and/or mounted in a perfectly arrangement or alignment, rather than having to continually adjust or relevel the sealing assemblies with respect to one another (particularly in response to repeated use of the packaging machine and sealing bars and/or other, external factors such as exposure to extreme heat or cold environments), such inconsistencies or inaccuracies can be substantially accommodated and effectively minimized by the engagement between the upper and lower sealing assemblies, e.g., due to compression and/or deformation of the sealing tubes/bladders 166, which can substantially automatically adjust or compensate for such inconsistencies between the surfaces, without necessarily requiring external adjustments such as applying shims or releveling the machine, etc.

Figure 7:
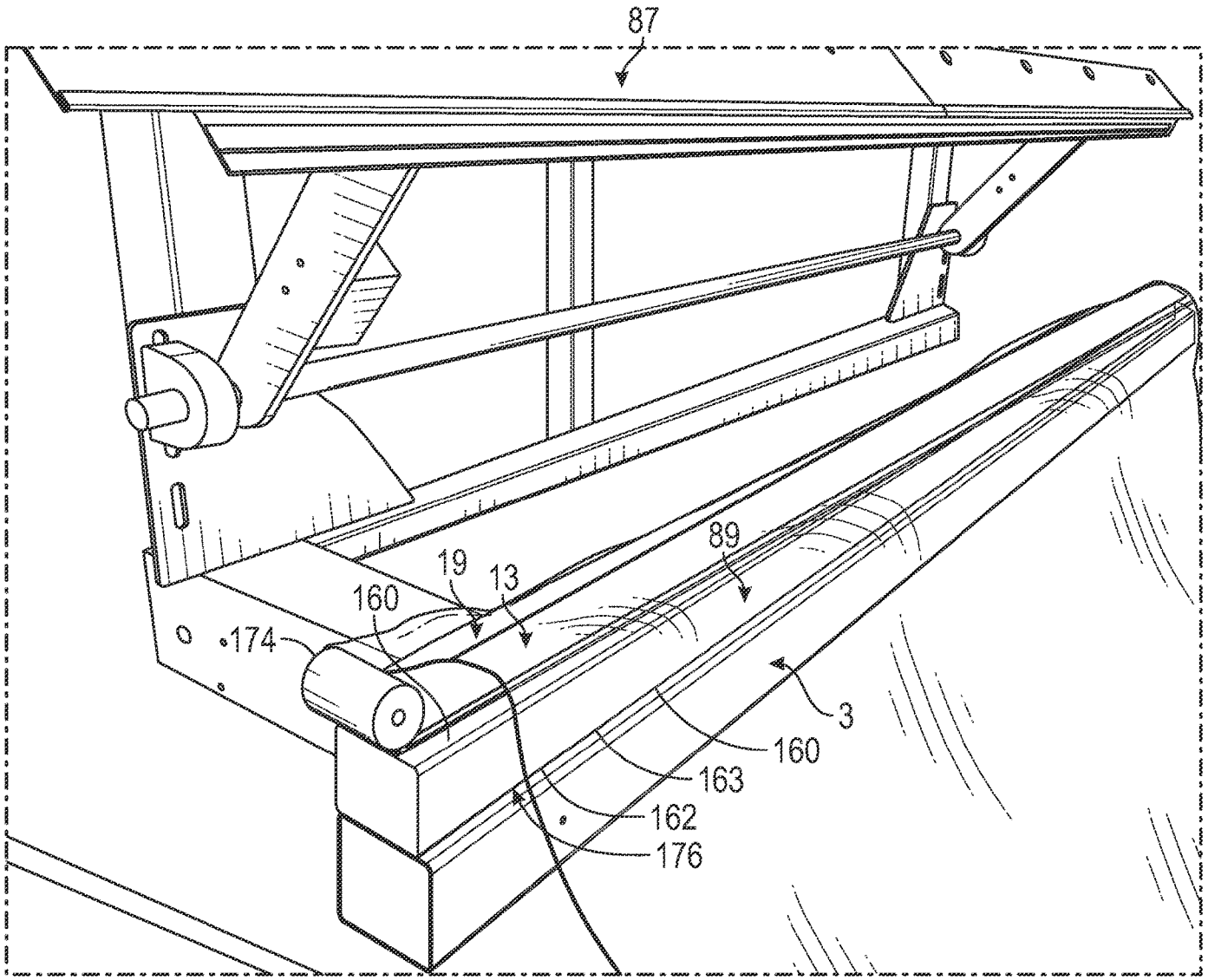
FIG. 7 is a perspective view of a seal formed along the sealing assemblies.
Figure 8:
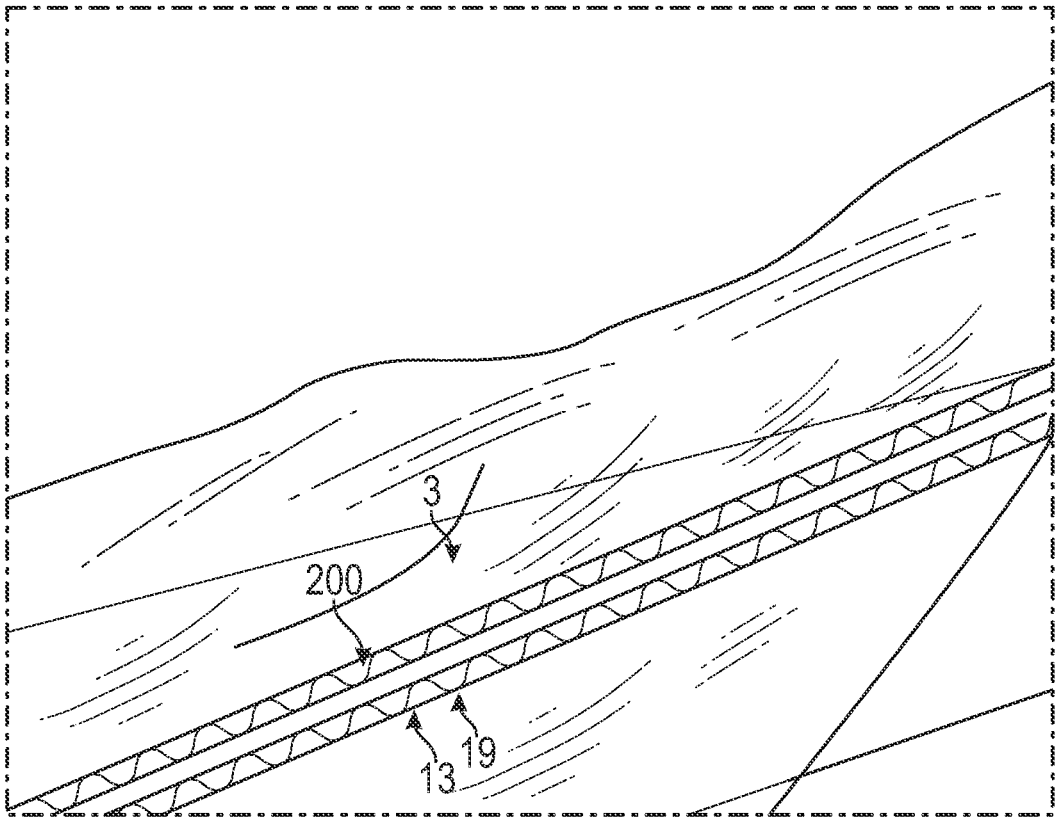
FIG. 8 is a perspective view of a seal formed by the sealing assemblies.

As indicated in FIGS. 7 and 8, as the upper sealing assembly 87 is lowered and entered into engagement with or to bear against the sealing tubes 166 of the lower sealing assembly 89, sealing tubes can be compressed or expanded as needed, as the fluid material flows therethrough in response to the pressure of the upper sealing assembly 87 at varying points along the length of the lower sealing assembly 89, to enable a substantially consistent and secure seal to be formed between the webs 13, 19 of plastic sheeting material, while at the same time enabling the edges of the sealed package to be perforated or substantially cut as needed. This can further result in a substantially stronger seal being formed between the webs 13, 19 of plastic sheeting material, which can be more resistant to tearing or rupture during transport of the packaged mattresses, box springs or other products.

The machine 1 also generally will include a machine control, for example, a control panel, generally indicated 185, operable for control and monitoring of the operation of the machine and the heating elements 151 in the sealing assemblies, e.g., 77, 81 and 83, to heat the seal bars 121, 123 and cutting elements 125 of the upper sealing assembly 87 so that as the seal bars are pressed into contact with the plastic sheeting material 3, the webs 13, 19 of the plastic sheeting material will melt and become sealed together to thus form a seam 200 between the plies of the material, and close the open side edges of the packaging material about the mattress P being packaged.

In one embodiment, the packaging machine 1 also will include a right side compression assembly, generally indicated at 201, and a left side compression assembly (not shown) for compressing a respective right and left side RS, LS of the mattress P prior to operation of the right and left side sealing assemblies 83, 81. As shown in FIG. 3, each compression assembly (the right side compression assembly 201 being shown in FIG. 3) includes a compression bar 205 with opposite ends 207, 209 that is movably mounted on the frame 23 and a first and second actuator 211, 213 in the form of air cylinders respectively positioned adjacent opposite ends of the compression bar. Alternatively, the compression assembly 201 may include a single actuator mounted adjacent either end of the compression bar 205 or a single actuator mounted at the middle of the compression bar without departing from the scope of this disclosure.

In the illustrated embodiment, the compression assembly 201 can include a synchronizing mechanism, generally indicated at 221 for synchronizing the movement of the compression bar 205 so that the opposite ends 207, 209 of the compression bar move from a raised, non-actuated position (FIG. 3) to a lowered, actuated position at a substantially equal speed. The synchronizing mechanism 221 synchronizes the movement of the compression bar 205 so that the compression bar remains substantially parallel to the upper surface of the product P during movement between the non-actuated position and the actuated position. It is understood that the synchronizing mechanism 221 may have other configurations without departing from the scope of this disclosure.

Each compression assembly 201 of the machine 1 also may be operated in either a low pressure mode or a high pressure mode. In the high pressure mode, the air supplied to the actuators 211, 213 is routed through a first air pressure regulator (not shown) that is set at a high pressure setting (e.g., about 50-60 psi or greater) to supply compressed air to the actuators at a pressure resulting in the application of the desired amount of compression force by the compression bars 205 contacting the product P during operation in the high pressure mode. In the low pressure mode, the air supplied to the actuators 211, 213 is routed through a second air pressure regulator (not shown) that is set at a low pressure setting to supply compressed air to the actuators at a pressure resulting in the application of the lower amount of compression force by the compression bar 205 contacting the product P during operation. It is understood that operation of the compression assemblies 201 in the high pressure mode may be suitable for stiffer products P (e.g., a firm mattress, foundation, box spring, etc.) and the operation of the compression assemblies in the low pressure mode may be suitable for softer products (e.g., a softer mattress or a pillow top mattress). The selection of the high pressure mode or the low pressure mode of operation of the compression assemblies 201 may be made by the operator at the control panel 185 of the machine 1. Further, the compression assemblies 201 may be turned off at the control panel 185 so that the product P is packaged in the machine 1 without the operation of the compression assemblies. It is further understood that the compression assemblies 201 may be operated in a distance mode wherein each of the compression assemblies of the machine 1 compresses the product P by a set amount or distance. In the distance mode, sensors (e.g., optical sensors, not shown) may be used to detect when the compression bar 205 contacts the top of the product P and to detect when the compression bar has been moved down a preset distance (e.g., about 2 inches) after contacting the top of the product so that the product is compressed by a preset amount of compression. The control panel 185 may include switches to allow an operator to select between the low pressure mode, high pressure mode, distance mode, or to turn off the operation of the compression assemblies 201.

The packaging machine 1 of the present disclosure additionally can include an upper roll replacement system, generally indicated at 241, for replacing the upper roll 11 of packaging material 3 that is located on the top of the packaging machine. The upper roll replacement system 241 includes a storage area, generally indicated at 243, for storing replacement rolls 245 of packaging material in a stored position generally adjacent the roll 11 of packaging material that is mounted in the cradle 43 for supplying the upper web 13 of packaging material to the machine 1, with a gravity feed mechanism for moving the replacement roll into place. As shown in FIGS. 1A and 1B, the packaging machine 1 can include or utilize an overhead crane system, generally indicated at 261, either as part of the machine or as existing in the facility in which the machine is operated, to lower replacement rolls 245 into the upper roll replacement system 241. The crane system 261 enables each roll 245 to be loaded, raised, and placed into position for use. A lower roll replacement system 265 further is provided for the movable carriage 45 on the bottom of the packaging machine 1, and can be substantially similar to the upper roll replacement system 241 in the lower system, including a gravity feed system. Replacement rolls can be loaded into the lower roll replacement system from the crane system or directly from a forklift or other lifting mechanism.

The machine 1 of the illustrated embodiment further can include an upper packaging material sensor 52 mounted on the frame 23 generally near the top of the product receiving area 5 near the input end 25 of the machine 1 to detect when the upper roll 11 of packaging material is empty. The packaging material sensor 52 is positioned to direct a beam of light at the top of the packaging area 5 that is directed at a reflector (not shown) mounted on the frame. The sensor 52 is positioned such that the beam of light is interrupted by the upper web 13 that extends at a slight downward angle from the upper roll 11 mounted on the cradle rollers 53 to the pinch rollers 47 when the machine is operating. When the upper roll 11 of packaging material is empty, the free end of the upper web 13 will hang loosely down from the pinch rollers 47 at the top of the machine 1 in the product receiving area 5 exposing the reflector to the beam of light from the sensor 52. When the beam of light from the sensor 52 is reflected by the reflector, the sensor detects that the upper roll has run out of packaging material and the machine is shut down to allow an operator to load a new roll of packaging material. The web of packaging material from the new roll and the web of packaging material from the expired roll must be joined together to reform the upper web 13 before the machine 1 is restarted. It is understood that a lower packaging material sensor (not shown) operates in a similar manner as the upper packaging material sensor 52 to detect when the packaging material 3 from the bottom roll 17 has run out.

As shown in FIG. 1A, an upper edge wrapping material or boot film applicator, generally indicated at 281, and lower edge wrapping material applicator, generally indicated at 283, can be positioned adjacent the inlet end of the machine. The upper end wrapping material applicator 281 includes a first and second roll 285, 287 of end wrapping material that is positioned for dispensing wrapping material over the left and right sides of the mattress. Typically, the edge wrapping material is a thicker plastic film than the packaging material 3 and provides additional protection to the sides LS, RS of the mattress P. The upper edge wrapping material applicator 281 applies edge wrapping material that is coextensive with the upper web 13 of packaging material 3 and the lower edge wrapping material applicator 283 applies edge wrapping material that is coextensive with the lower web 19 of packaging material such that the edge wrapping material is sealed simultaneously when the webs of packaging material are sealed by the end sealing assembly 77 and right and left side sealing assemblies 81, 83 of the machine 1. It is understood that a manual sealing assembly and hand sealer may be used in a similar manner as described above for the upper web 13 of packaging material to reattach edge wrapping material from the upper edge wrapping material applicator and/or the lower edge wrapping material when the corresponding rolls of edge wrapping material run out of material.

The packaging machine 1 of the present disclosure is operated to package the product such as the mattress P shown in the illustrated embodiment in a protective enclosure of packaging material 3. The mattress P is loaded on the product receiving area 5 at the inlet end 25 of the machine and is moved by the conveyors 31, 33 along the path of travel in the machine until the downstream end D of the mattress reaches the gate at the end of the product receiving area of the machine. The movable guide 37 is actuated to laterally position the mattress P in the product receiving area 5 so that the mattress is correctly aligned for packaging. After the mattress P has been properly positioned against the stationary side guide 39, the gate is lowered and the mattress P is allowed to pass into the packaging area 7. As the mattress P passes into the packaging area 7, the upper and lower drive roller motors are actuated to pull the upper and lower webs 13, 19 of packaging material. The downstream end D of the mattress P engages the seal between the upper and lower webs 13, 19 at the inlet of the packaging area 7 that is preformed to create the seal at the downstream end of the mattress being packaged. The mattress P is enveloped by the plastic packaging material 3 to form an open ended sleeve, with the left and right sides LS, RS and upstream end U of the mattress P remaining unclosed.

Once the mattress P enters the packaging area 7, the tension roller 51 is activated to press against the top surface of the mattress as it moves through the packaging area to provide a downward force on the mattress P that increases the traction of the belts 38 of the conveyors 32, 34. When the upstream end U of the mattress P has cleared the end sealing assembly 77, the end sealing assembly is actuated to seal the upper and lower webs 13, 19 of packaging material 3 at the upstream end and to cut the upper and lower webs to form the seal at the downstream end D of the next mattress to be packaged. The mattress P advances further into the packaging area 7 where the left and right side compression assemblies 201 are actuated to press against the left and right sides LS, RS of the mattress P to flatten the upper web 13 of packaging material 3 so that the packaging material forms a close fit to the mattress, and also can compact the height of the mattress at least approximately two inches to provide a further tight fit of the packaging material 3, and the compression of the mattress P by the compression assemblies allows the width of the upper web 13 of packaging material to be reduced, as compared to the width of the upper web that is needed if the compression assemblies are not used. Thereafter, the upper sealing assembly 87 of each of the left and right side sealing assemblies 81, 83 is actuated so as to create the left and right side seal between the upper and lower webs 13, 19 of packaging material 3. After the left and right side seals are formed, the packaged mattress P is ejected from the packaging machine 1 and the next mattress to be packaged is sent through the machine.

The foregoing description generally illustrates and describes various embodiments of the present disclosure. It will, however, be understood by those skilled in the art that various changes and modifications can be made to the above-discussed construction of the present disclosure without departing from the spirit and scope of the disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A packaging machine for applying a packaging material to a product comprising:

a supply of the packaging material arranged along a path of travel of the product so as to be engaged by and applied about the product as the product moves along the path of travel in a packaging area;

an upper sealing assembly located along the packaging area, the upper sealing assembly comprising an upper sealing element; and a lower sealing assembly located opposite to the upper sealing assembly, the lower sealing assembly comprising a lower sealing element and one or more inflatable sealing tubes configured to receive a fluid therein so as to be expandable and compressible, wherein the lower sealing element is operably coupled to the one or more inflatable sealing tubes such that a position of the lower sealing element adjusts, relative to the upper sealing element, in response to a force bearing on the lower sealing element due to compression or expansion of the fluid within the one or more inflatable sealing tubes to compensate for inconsistencies in engagement between the upper and lower sealing assemblies;

wherein at least one of the upper sealing element or the lower sealing element is moveable towards the other of the upper sealing element or the lower sealing element and the position of the lower sealing element adjusts, due to the operable coupling with the one or more inflatable sealing tubes, to the upper sealing element to engage, heat, and seal a portion of the packaging material between the upper sealing element and the lower sealing element.

2. The packaging machine of claim 1, wherein the lower sealing element comprises at least one of a compressible insulating material and a non-stick, heat resistant material covering the one or more inflatable sealing tubes for protecting the one or more sealing tubes from direct application of heat.

3. The packaging machine of claim 1, wherein the lower sealing element comprises a compressible insulating material and a non-stick, heat resistant material, wherein the portion of the packaging material is engaged between the upper sealing element of the upper sealing assembly and the compressible insulating material and the non-stick, heat resistant material of the lower sealing element.

4. The packaging machine of claim 3, wherein the non-stick, heat resistant material is applied over the one or more inflatable sealing tubes, and the compressible insulating material is arranged along the non-stick, heat resistant material.

5. The packaging machine of claim 3, wherein the compressible insulating material comprises a silicone sponge and the non-stick, heat resistant material comprises a non-stick tape.

6. The packaging machine of claim 1, wherein the upper sealing element of the upper sealing assembly comprises one or more sealing bars and at least one cutting blade, and wherein the portion of the packaging material is engaged between the one or more inflatable sealing tubes of the lower sealing assembly and each of the at least one cutting blade and the one or more sealing bars of the upper sealing assembly.

7. The packaging machine of claim 6, wherein the one or more sealing bars comprise at least two sealing bars at spaced apart locations, and wherein the cutting blade is positioned between the at least two sealing bars.

8. The packaging machine of claim 1, wherein the lower sealing assembly further comprises a support defining a trough, and wherein the inflatable sealing tubes are located within the trough.

9. The packaging machine of claim 8, wherein the support comprises outwardly extending flanges, and wherein the lower sealing element comprises a non-stick material applied over the flanges and the trough of the support.

10. The packaging machine of claim 1, wherein the one or more inflatable sealing tubes comprise one or more tubular members that are connected to a fluid supply for at least partially inflating the one or more tubular members.

11. The packaging machine of claim 1, wherein the lower sealing assembly further comprises a fluid supply connected to the one or more inflatable sealing tubes for supplying a fluid thereto and a regulator for controlling the supply of fluid to the one or more inflatable sealing tubes to maintain a desired pressure therein.

12. A method of packaging products, comprising:

moving each product along a path of travel through a packaging area;

feeding a packaging material into registration with each product moving along the path of travel;

moving an upper sealing assembly having an upper sealing element into engagement with a lower sealing assembly having a lower sealing element and one or more inflatable sealing tubes configured to receive a fluid therein;

forming a thermal bond between one or more portions of the packaging material by engagement of the packaging material between the upper sealing assembly and the lower sealing assembly and applying heat thereto; and controlling a volume of fluid within the inflatable sealing tubes such that the inflatable sealing tubes are expandable and compressible along the length thereof to adjust the lower sealing element relative to the upper sealing element in response to a force bearing on the lower sealing element due to compression or expansion of the fluid within the one or more inflatable sealing tubes to compensate for inconsistencies in engagement between the upper and lower sealing assemblies and maintain a substantially consistent counter-engaging sealing contact between the upper sealing element and the lower sealing element along a length thereof during the forming the thermal bond.

13. The method of claim 12, wherein the lower sealing element comprises at least one of a compressible insulating material and a non-stick, heat resistant material covering the one or more inflatable sealing tubes for protecting the one or more sealing tubes from direct application of heat during the forming the thermal bond.

14. The method of claim 12, wherein the lower sealing element comprises a compressible insulating material and a non-stick, heat resistant material, and wherein the forming the thermal bond comprises engaging the one or more portions of the packaging material between the upper sealing element of the upper sealing assembly and the compressible insulating material and the non-stick, heat resistant material of the lower sealing element.

15. The method of claim 14, wherein the non-stick, heat resistant material is applied over the one or more inflatable sealing tubes, wherein the compressible insulating material is arranged along the non-stick, heat resistant material, and wherein the lower sealing element further comprises an upper layer of heat resistant and non-stick material coving the compressible insulating material.

16. The method of claim 14, wherein the forming the thermal bond comprises moving the upper sealing element into contact with the one or more portions of the packaging material to bear against the compressible insulating material, the non-stick, heat resistant material, and the one or more inflatable sealing tubes.

17. The method of claim 12, wherein the upper sealing element of the upper sealing assembly comprises one or more sealing bars and a cutting blade, and wherein the forming the thermal bond comprises engaging the one or more portions of the packaging material between the one or more inflatable sealing tubes of the lower sealing assembly and each of the cutting blade and the one or more sealing bars of the upper sealing assembly.

18. The method of claim 17, wherein the one or more sealing bars comprise at least two sealing bars at spaced apart locations, and wherein the cutting blade is positioned between the sealing bars.

19. The method of claim 17, wherein the forming the thermal bond comprises moving the one or more sealing bars and the cutting blade into contact with the packaging material to bear against the lower sealing element and the one or more inflatable sealing tubes.

20. The method of claim 12, wherein the one or more inflatable sealing tubes comprises a plurality of inflatable sealing tubes, each connected to a fluid supply, and wherein the controlling the volume of fluid in the inflatable sealing tubes comprises controlling the fluid supply to at least partially inflate each of the one or more inflatable sealing tubes.

* * * * *